US009409133B2

(12) United States Patent
Baltussen et al.

(10) Patent No.: US 9,409,133 B2
(45) Date of Patent: Aug. 9, 2016

(54) ASSEMBLY FOR THE PRODUCTION OF DISPERSIONS

(75) Inventors: Jozef Johannes Maria Baltussen, Nijmegen (NL); Marco Ypma, Duiven (NL)

(73) Assignee: AKZO NOBEL COATINGS INTERNATIONAL B.V., Arnhem (NL)

( * ) Notice: Subject to any disclaimer, the term of this patent is extended or adjusted under 35 U.S.C. 154(b) by 451 days.

(21) Appl. No.: 13/990,825

(22) PCT Filed: Dec. 9, 2011

(86) PCT No.: PCT/EP2011/072262

§ 371 (c)(1),
(2), (4) Date: May 31, 2013

(87) PCT Pub. No.: WO2012/076675

PCT Pub. Date: Jun. 14, 2012

(65) Prior Publication Data

US 2013/0242687 A1 Sep. 19, 2013

(30) Foreign Application Priority Data

Dec. 9, 2010 (GB) ..... 1020923.7

(51) Int. Cl.
*B01F 5/10* (2006.01)
*B01F 3/12* (2006.01)
(Continued)

(52) U.S. Cl.
CPC ..... *B01F 3/1271* (2013.01); *B01F 3/1221* (2013.01); *B01F 5/0065* (2013.01);
(Continued)

(58) Field of Classification Search
CPC ..... B01F 5/0065
USPC ..... 366/136, 165.1–165.5
See application file for complete search history.

(56) References Cited

U.S. PATENT DOCUMENTS 24,686 A * 7/1859 Wicks ..... A01J 25/115
366/136
626,950 A 6/1899 Wheelwright
(Continued)

FOREIGN PATENT DOCUMENTS

EP 0 491 981 7/1992
EP 0 768 113 4/1997
(Continued)

OTHER PUBLICATIONS

International Search Report and Written Opinion for International Application No. PCT/EP2011/072262 mailed on Jun. 18, 2012.
(Continued)

*Primary Examiner* — David Sorkin
(74) *Attorney, Agent, or Firm* — Kenyon & Kenyon LLP

(57) ABSTRACT

An assembly for the production of dispersions including a mixing unit (7) and a circulation tank (1) for holding liquid, the mixing unit (7) including a first solid inlet (8) for receiving a solid, a second liquid inlet for receiving the liquid, a mixing chamber where the liquid and solid are mixed, and a return outlet (13), the liquid inlet is fluidly connected to the circulation tank (1) such that liquid in the circulation tank flows to the mixing unit (7) via a circulation tank outlet (4), the return outlet (15) transferring the combined liquid and solid from the mixing chamber (7) into the circulation tank (1) via a circulation tank inlet. The circulation tank has an interior height which is configured such that a chamber exists inside the tank above the level of the liquid. Alternatively, the circulation tank inlet is permanently positioned above the liquid level or it includes a pipe configured such that the dispersion forms a film on its inner surface. Alternatively, the circulation tank includes an impeller having a diameter equal to or greater than 0.5 times the internal diameter of the tank.

13 Claims, 4 Drawing Sheets

(51) Int. Cl.

| | |
|---|---|
| ***B01F 5/00*** | (2006.01) |
| ***B01F 7/16*** | (2006.01) |
| ***B01F 7/18*** | (2006.01) |

(52) U.S. Cl.

CPC ..... *B01F 5/104* (2013.01); *B01F 5/106* (2013.01); *B01F 7/1625* (2013.01); *B01F 7/18* (2013.01); *B01F 2215/0431* (2013.01); *B01F 2215/0495* (2013.01)

(56) References Cited

U.S. PATENT DOCUMENTS

| | | | | | |
|---|---|---|---|---|---|
| 1,444,255 | A | * | 2/1923 | Lidholm | C01C 3/16 366/136 |
| 1,722,433 | A | * | 7/1929 | Kirschbraun | B01F 3/088 366/136 |
| 1,727,152 | A | * | 9/1929 | Winkler | B01F 5/162 261/90 |
| 1,777,646 | A | * | 10/1930 | Klein et al. | B29B 15/02 366/136 |
| 1,947,851 | A | * | 2/1934 | Jewett | B01F 5/102 366/136 |
| 2,516,884 | A | * | 8/1950 | Kyame | D06B 23/20 118/602 |
| 3,830,473 | A | * | 8/1974 | Lieferman | C09J 103/00 366/136 |
| 4,693,609 | A | * | 9/1987 | Haynes | B01F 13/10 366/136 |
| 5,103,908 | A | * | 4/1992 | Allen | B01F 3/04836 166/285 |
| 6,607,648 | B1 | * | 8/2003 | Franceschetti | A61K 8/0245 204/557 |
| 8,333,914 | B2 | | 12/2012 | Pitsch et al. | |
| 2003/0107948 | A1 | | 6/2003 | Jacob | |
| 2009/0202835 | A1 | | 8/2009 | Pitsch et al. | |

FOREIGN PATENT DOCUMENTS

| | | |
|---|---|---|
| EP | 1 787 958 | 5/2007 |
| FR | 1333222 | 7/1963 |
| JP | 2007-105590 | 4/2007 |
| WO | 2008/024847 | 2/2008 |

OTHER PUBLICATIONS

International Preliminary Report on Patentability for International Application No. PCT/EP2011/072262 mailed on Jun. 20, 2013.

* cited by examiner

Prior art

ASSEMBLY FOR THE PRODUCTION OF DISPERSIONS

REFERENCE TO RELATED APPLICATIONS

This application is the U.S. National Phase of PCT/EP2011/072262 filed on Dec. 9, 2011, and claims the benefit of Application No. GB 1020923.7, filed on Dec. 9, 2010.

The present invention relates to an assembly, in particular to an assembly for the production of dispersions of high viscous liquids, highly loaded dispersions or dispersions with a high yield stress for use in coating compositions such as paints.

It is known to disperse powders into a liquid using a mixing unit with a first and second inlet and a product outlet as described in US2003107948.

The first inlet is for the liquid phase and the second inlet is for the solid phase. The liquid phase is typically a dispersion of particles, liquids and/or gases in liquid. The solid phase is typically a powder. The liquid phase is pumped by the mixing unit from one of the inlets through the outlet. The pumping action of the mixing unit causes suction on the inlet for the solid phase, which causes the powder to flow into the mixing unit and disperse into the liquid phase. The liquid product made by the mixing unit is then transferred and held in the circulation tank.

For highly viscous liquids, highly loaded dispersions, dispersions with a high yield stress or dilatant dispersions, known assemblies suffer from blockage of the machine, or a very low rate of powder incorporation.

A further problem of known assemblies is that of an undesirable air incorporation in the liquid product. This may further increase the viscosity of the product or reduce the suction capacity of the mixing unit.

According to the present invention there is provided an assembly for the production of dispersions including a mixing unit and a circulation tank for holding liquid, the mixing unit including a first solid inlet for receiving a solid, a second liquid inlet for receiving the liquid, a mixing chamber where the liquid and solid are mixed, and a return outlet, the liquid inlet is fluidly connected to the circulation tank such that liquid in the circulation tank flows to the mixing unit via a circulation tank outlet, the return outlet transferring the combined liquid and solid from the mixing chamber into the circulation tank via a circulation tank inlet, in which the circulation tank has an interior height which is configured such that a chamber exists inside the tank above the level of the liquid.

According to another aspect of the present invention there is provided an assembly for the production of dispersions including a mixing unit and a circulation tank for holding liquid, the mixing unit including a first solid inlet for receiving a solid, a second liquid inlet for receiving the liquid, a mixing chamber where the liquid and solid are mixed, and a return outlet, the liquid inlet is fluidly connected to the circulation tank such that liquid in the circulation tank flows to the mixing unit via a circulation tank outlet, the return outlet transferring the combined liquid and solid from the mixing chamber into the circulation tank via a circulation tank inlet, in which the circulation tank inlet is permanently positioned above the liquid level.

According to another aspect of the present invention there is provided an assembly for the production of dispersions including a mixing unit and a circulation tank for holding liquid, the mixing unit including a first solid inlet for receiving a solid, a second liquid inlet for receiving the liquid, a mixing chamber where the liquid and solid are mixed, and a return outlet, the liquid inlet is fluidly connected to the circulation tank such that liquid in the circulation tank flows to the mixing unit via a circulation tank outlet, the return outlet transferring the combined liquid and solid dispersion from the mixing chamber into the circulation tank via a circulation tank inlet, the circulation tank having a wall with an inner surface, in which the circulation tank inlet includes a pipe which is configured such that the dispersion forms a film on the inner surface.

According to another aspect of the present invention there is provided an assembly for the production of dispersions including a mixing unit and a circulation tank for holding liquid, the mixing unit including a first solid inlet for receiving a solid, a second liquid inlet for receiving the liquid, a mixing chamber where the liquid and solid are mixed, and a return outlet, the liquid inlet is fluidly connected to the circulation tank such that liquid in the circulation tank flows to the mixing unit via a circulation tank outlet, the return outlet transferring the combined liquid and solid from the mixing chamber into the circulation tank via a circulation tank inlet, the circulation tank has an internal diameter $D_T$, and includes an impeller with an impeller diameter $D_I$, in which $D_I$ is equal to or greater than 0.5 $D_T$.

The invention will now be described by way of example only with reference to the following drawings.

Figure 6:
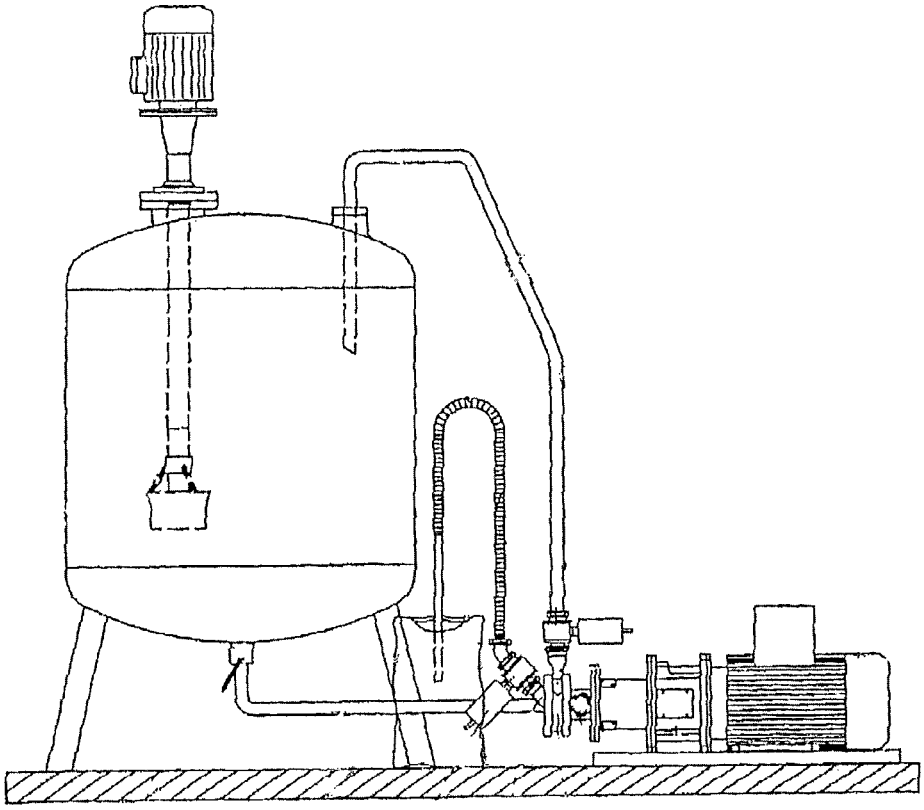
FIG. 6 is a front sectional view of a known assembly for the production of dispersions.

In FIG. 6 there is shown a known assembly for the production of dispersions. Such an assembly is described in US2003107948, the contents of which are herein incorporated by reference.

Figure 1:
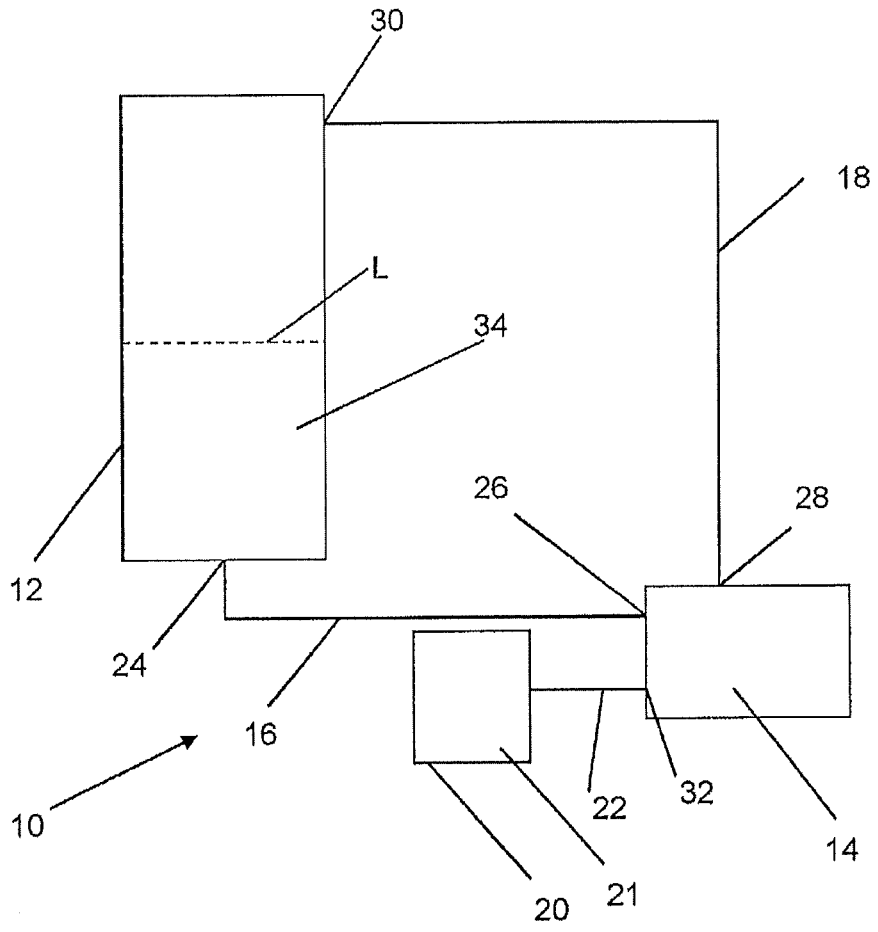
FIG. 1 is a front schematic view of an assembly according to the present invention.

In FIG. 1, an assembly 10 includes a circulation tank 12 and a mixing unit 14. The circulation tank 12 is of cylindrical section, but alternative sections are envisaged.

The circulation tank 12 is fluidly connected to the mixing unit 14 via a liquid inlet pipe 16, the liquid inlet pipe 16 being connected to the circulation tank 12 at tank outlet 24 and to the mixing unit 14 at second liquid inlet 26.

The circulation tank 12 has a height H and an internal diameter $D_T$.

Figure 2:
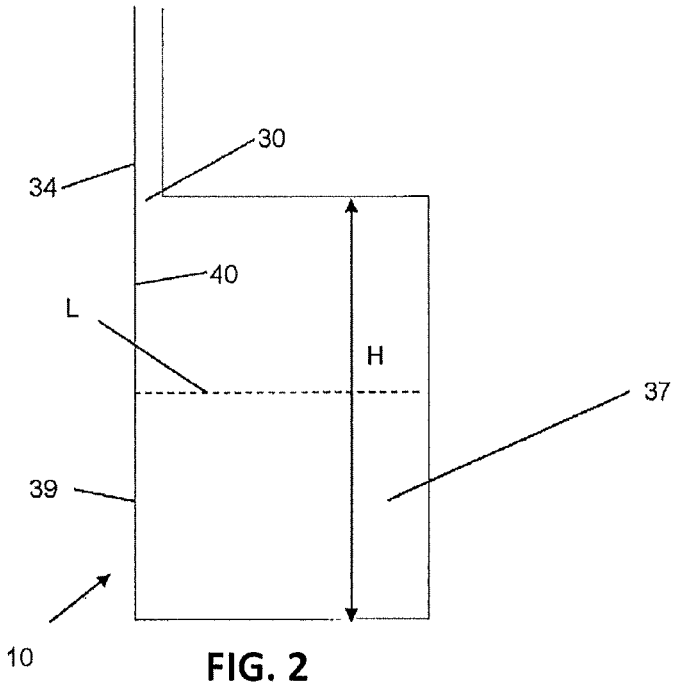
FIG. 2 is a front view of part of an assembly according to the present invention.
Figure 3:
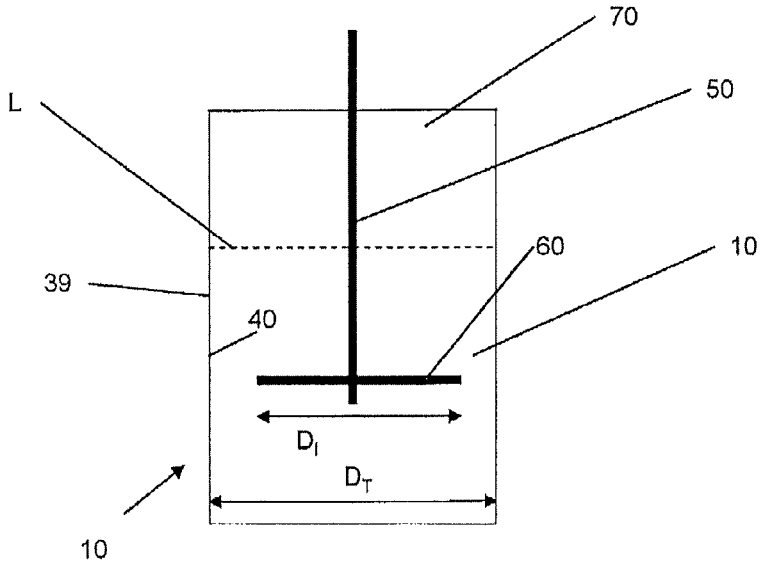
FIG. 3 is a front view of part of an alternative assembly.

The circulation tank 12 has cylindrical wall 30 with an inner surface 40 (FIGS. 2 and 3).

The circulation tank 12 includes a mixer 50 with an impeller 60 of diameter $D_T$. The impeller can be an axial or a mixed flow impeller. Definitions for impellers can be found in Edward L. Paul, Victor A. Atiemo-Obeng, Suzanne M. Kresta, "Handbook of industrial mixing", 2004.

In an alternative embodiment the impeller is a double action impeller having a different pitch of the inner and outer part of the impeller blades.

In both embodiments it can be favourable to mount more impellers on a single mixer shaft. Typically the number of impellers needed for the configuration of this invention is equal to the number obtained by dividing the liquid height by the tank diameter, rounded to the next larger integer.

Mixing time is defined from the development of the concentration profile adding a tracer at the position of the inlet of the circulation tank. When the pulse of tracer is added to the vessel there will be a localised high concentration where it is added to the vessel, but the average concentration across the vessel will be $\bar{c}$. As the mixing process progresses the localised concentrations will decrease and approach $\bar{c}$. A point in time will be reached when the concentration of tracer at any and every point in the vessel will be within ±10% of the calculated mean value, $\bar{c}$. This maximum 5% deviation in concentration is defined as the time for 90% homogeneity—the FMP default mixing time. Any other degree of degree of mixing is defined in an analogous way.

The powder induction time will depend on the size of the rotor/stator, which is characterized by the motor power P of the machine.

The nominal tank volume of the installation of this invention is preferably larger than 200 liters, more preferably larger than 750 liters, even more preferably larger than 2000 liters and most preferably larger than 5000 liters.

For calculation of the induction time a reference dispersion with a solid content of 50 wt % is used. When the circulation tank is filled to its nominal value the weight of the dispersion is called 2M, the weight of the solids in the dispersion is equal to M. The average powder flow rate Φ for rotor/stators with a motor power larger than 20 kW is defined by:

$$\Phi(P)=3.1\,P+23, \text{ with } P \text{ in kW and } \Phi \text{ in kg/min.}$$

Now the induction time $\tau_{induct}$ for the rotor stator is calculated by:

$$\tau_{induct}=M/\Phi, \text{ with M in minutes, } \Phi \text{ in kg/min and } \tau_{induct} \text{ in minutes.}$$

The mixing time of tank configuration can be determined by a Computational Fluid Dynamics calculation. In this calculation the addition of a tracer pulse at the inlet of the circulation tank is simulated. In this calculation the circulation flow is set to zero and the physical properties of the viscous end product or intermediate are used. Such a calculation is performed with a suitable software package such as Fluent, CFX or a comparable software package. The calculation is performed according to industrial practice for CFD calculations on mixed tanks.

The mixing unit 14 is further fluidly connected to the circulation tank 10 via liquid return pipe 18, the return pipe 18 being connected to the mixing unit at return outlet 28, and to the circulation tank at circulation tank inlet 30. In FIG. 2, it can be seen that tank inlet 30 includes a tank inlet pipe 34.

A container 20 includes solid material, typically, powder 21. The container 20 is connected to the mixing unit 14 via a solid inlet pipe 22 at solid inlet 32.

The container tank initially contains liquid 37 at a level L.

In operation, a mixing unit pump (not shown) draws liquid 37 from the circulation tank 12 into a mixing chamber (not shown) of the mixing unit 14 via pipe 16. The action of the mixing unit pump causes the powder 21 from container 20 to flow into the mixing chamber via pipe 22 where it is dispersed into the liquid phase in the mixing chamber.

The dispersion is then transferred to the circulation tank 12 via return outlet 28, and enters the circulation tank through tank inlet 30.

It will be appreciated that the liquid 37 in the tank is a mixture of the dispersion of liquid and solid from the mixing unit, and that the mixing unit is continually with liquid from that tank which is mixed with more powder in the mixing unit before it is again returned to the tank, i.e. it is a continuous dispersion process.

In FIGS. 1 and 2 it can be seen that the tank inlet 30 is above the liquid level L, with the height H of the tank configured such that, in use, the tank inlet 30 always remains above the liquid level L. The tank is also configured such that its height enables an air chamber 70 to always exist above the level of the liquid.

It can also be seen in FIG. 2 that tank inlet pipe 34 is radially tangential to the inner surface 40 of the tank such the liquid flowing into the tank forms a film on the inner surface 40.

Figure 4:
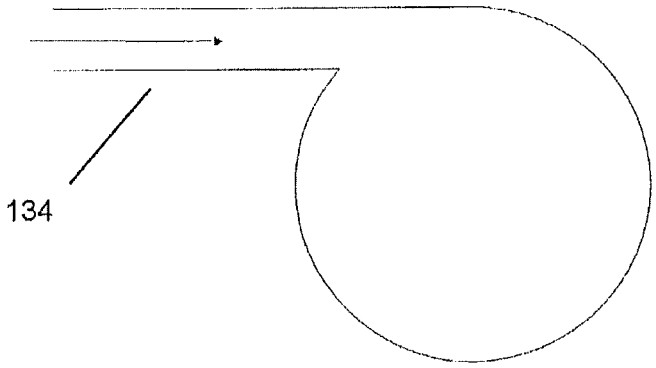
FIG. 4 is a plan view of part of an alternative assembly.

Alternatively (FIG. 4), the inlet pipe 134 into the tank is circumferentially tangential to the inner surface.

Figure 5:
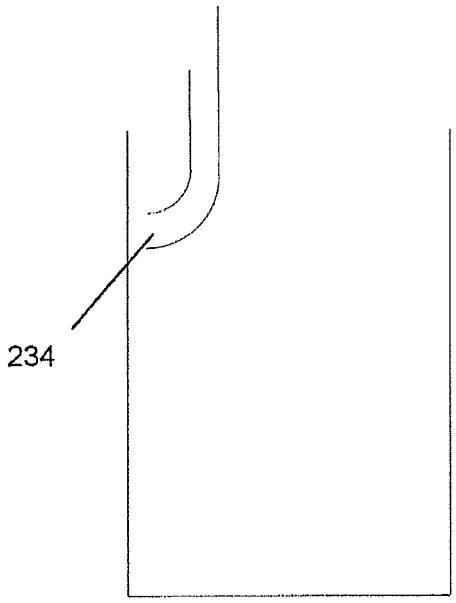
FIG. 5 is a front view of part of an alternative assembly.

Alternatively the inlet pipe 234 into the tank is configured such that liquid exiting the pipe flows directly onto the tank without the need to be tangential, for example, the pipe is angled as shown in FIG. 5.

The invention is typically useful for applications where the end product, or an intermediate state of the product is highly viscous, or has a high yield stress and/or the dispersion is dilatant. An extra complication is formed by a product or intermediate that has a high solid content.

The viscosity of dispersions is often a function of the shear rate, for this invention the viscosity is regarded in the range of 0.001 to 1 $s^{-1}$. The viscosity of the dispersion can be measured by a suitable rheometer, e.g. the AR 2000 of TA instruments or an instrument with comparable properties. For this invention the limit is defined at $\eta=(\gamma_{dot})^{2/3}$, with η the viscosity and $\gamma_{dot}$ the shear rate. These products have a viscosity higher than 1 Pas at a shear rate of 1 $s^{-1}$ and a viscosity higher than 100 Pas at a shear rate of 0.001 $s^{-1}$. The product is called highly viscous or having a yield stress in case the viscosity of the product as measured with the AR 2000 is higher than the limit viscosity for all shear rates in the range of 0.001 to 1 $s^{-1}$. The invention is even more useful for products with a very high viscosity or very high yield strength, defined by the limit at $\eta=10(\gamma_{dot})^{2/3}$. These products have a viscosity higher than 10 Pas at a shear rate of 1 $s^{-1}$ and a viscosity higher than 1000 Pas at a shear rate of 0.001 $s^{-1}$. Typical products with a high or very high viscosity are thickened by a thickening agent such as a CMC, HEC, EHEC or HASE thickener. The high viscosity may also be due to the high solid contents of the product.

The invention is also useful for highly viscous or very highly viscous products with a high solid contents, which is preferably equal or more than 45 wt %, more preferably equal or more than 60 wt % and even more preferably equal or more than 70 wt %.

The invention claimed is:

1. A continuous process for the production of dispersions in an assembly including a mixing unit and a circulation tank for holding a liquid; the mixing unit including a first solid inlet for receiving a solid, a second liquid inlet for receiving liquid, a mixing chamber for mixing liquid and solid, a return outlet, and a mixing unit pump; the circulation tank including a circulation tank outlet, a circulation tank inlet including a tank inlet pipe and the circulation tank having a wall with an inner surface, wherein the liquid inlet is fluidly connected to the circulation tank via an inlet pipe such that liquid in the circulation tank can flow to the mixing unit from the circulation tank outlet via the inlet pipe and the liquid inlet, wherein the mixing chamber is fluidly connected to the circulation tank via a liquid return pipe, the liquid return pipe being connected to the mixing unit at the return outlet and to the circulation tank at the circulation tank inlet, so that dispersion from the mixing chamber can be transferred into the circulation tank via the circulation tank inlet, the process comprising:

providing liquid contained in the circulation tank;

drawing liquid contained in the circulation tank into the mixing chamber via the inlet pipe by means of the mixing unit pump and allowing solid material to flow into the mixing chamber via the first solid inlet to form a dispersion of solid material in the liquid; and transferring the dispersion from the mixing chamber to the circulation tank via the circulation tank inlet, wherein the tank inlet pipe in the circulation tank inlet is configured such that the dispersion forms a film on the inner surface and wherein the tank inlet is permanently positioned above the liquid level in the circulation tank.

2. The process according to claim 1 wherein the pipe is tangential to the inner surface such that the dispersion flows directly onto the inner surface.

3. The process according to claim 2 wherein the pipe is circumferentially tangential to the inner surface.

4. The process according to claim 1 wherein the pipe is directed towards the inner surface such that the dispersion flows directly onto the inner surface.

5. The process according to claim 1, wherein the circulation tank has an internal diameter $D_T$, and includes an impeller with an impeller diameter $D_I$, wherein $D_I$ is equal to or greater than 0.5 $D_T$.

6. The process according to claim 5 wherein $D_I$ is equal to or greater than 0.6 $D_T$.

7. The process according to claim 5 wherein $D_I$ is equal to or greater than 0.64 $D_T$.

8. The process according to claim 1 wherein the dispersions have a solids content equal or more than 45 wt %.

9. The process according to claim 1 wherein the dispersions have a viscosity greater than 10 Pas at a shear rate of 1 $s^{-1}$ and a viscosity greater than 1000 Pas at a shear rate of 0.001 $s^{-1}$.

10. The process according to claim 2 wherein the dispersions have a solids content equal or more than 70 wt %.

11. The process according to claim 5 wherein the dispersions have a solids content equal or more than 70 wt %.

12. The process according to claim 5 wherein the dispersions have a viscosity greater than 10 Pas at a shear rate of 1 $s^{-1}$ and a viscosity greater than 1000 Pas at a shear rate of 0.001 $s^{-1}$.

13. The process according to claim 5 wherein the dispersions have a viscosity greater than 10 Pas at a shear rate of 1 $s^{-1}$ and a viscosity greater than 1000 Pas at a shear rate of 0.001 $s^{-1}$.

* * * * *